United States Patent [19]

Murakami et al.

[11] 3,937,049

[45] Feb. 10, 1976

[54] MONITORING SYSTEM FOR DIGITAL ELECTRONIC TIMEPIECE

[75] Inventors: Tomomi Murakami, Tokyo; Hideyuki Kawashima, Higashikurume, both of Japan

[73] Assignee: Citizen Watch Co., Ltd., Tokyo, Japan

[22] Filed: Mar. 6, 1974

[21] Appl. No.: 448,738

[30] Foreign Application Priority Data

Mar. 12, 1973 Japan ..... 48-28732
Apr. 11, 1973 Japan ..... 48-41117

[52] U.S. Cl. ..... 73/6
[51] Int. Cl.[2] ..... G04B 17/00; G04D 7/12
[58] Field of Search ..... 73/6; 58/23 R; 81/6; 324/189

[56] References Cited

UNITED STATES PATENTS

| | | | |
|---|---|---|---|
| 2,748,595 | 6/1956 | Hetzel | 73/6 |
| 3,838,564 | 10/1974 | Holcomb | 58/23 AC |
| 3,892,124 | 7/1975 | Reese | 73/6 |

*Primary Examiner*—Richard C. Queisser
*Assistant Examiner*—John S. Appleman
*Attorney, Agent, or Firm*—Ernest G. Montague; Karl F. Ross; Herbert Dubno

[57] ABSTRACT

An electronic timepiece provided with a liquid-crystal cell in a grounded casing, a common electrode on one side thereof and a segmented pattern electrode on the other side has a transparent shield electrode which is grounded to the casing and overlies the major part of the cell, with the exception of at least one window registering with a detecting electrode positioned on the glass cover of the casing. An ungrounded electrode underneath the window is pulsed by the electronic clockwork, the pulses being picked up by the detecting electrode and delivered to an evaluating device for measuring the operating rate of the timepiece. In one embodiment, two such windows associated with respective detecting electrodes are provided, one window registering with the common electrode at a location remote from all the segments of the pattern electrode, the other window being aligned with a coplanar extension of one of the segments of a digital array which is intermittently energized in the course of a pattern-forming cycle; the evaluator distinguishes between periods when the pulses picked up by the detecting electrodes are in phase and in phase opposition.

8 Claims, 9 Drawing Figures

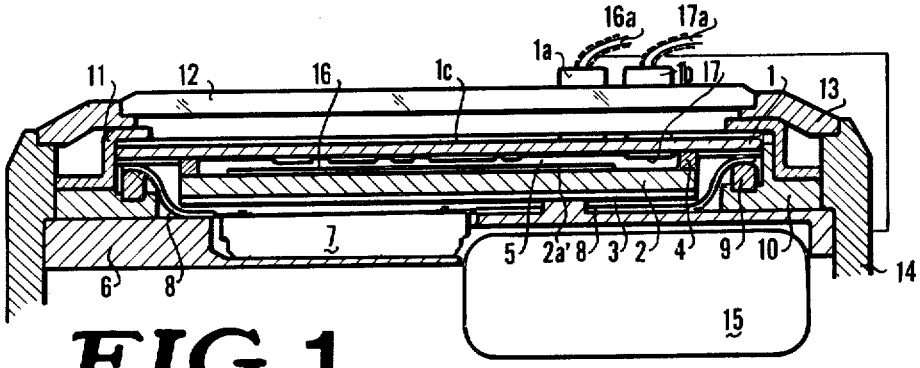
FIG. 1
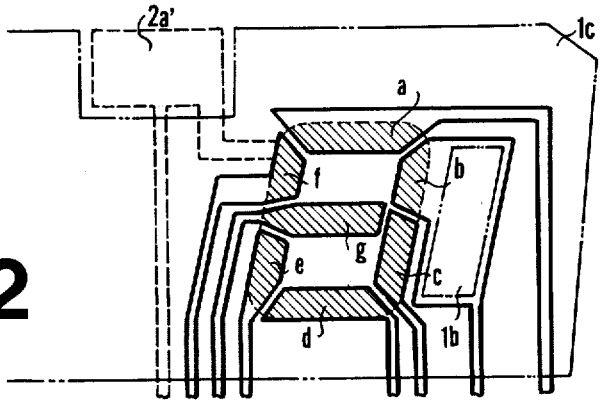
FIG. 2
FIG. 3
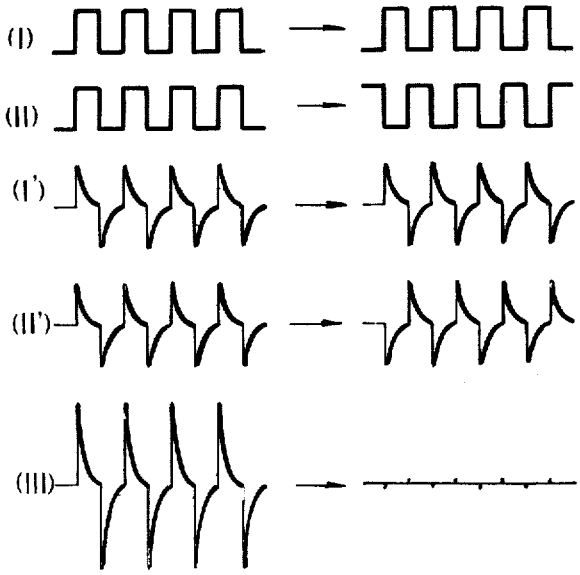

MONITORING SYSTEM FOR DIGITAL ELECTRONIC TIMEPIECE

This invention relates to electronic timepieces and more particularly to an electronic wristwatch which is capable of measuring the gain and loss in time keeping such as the difference in time indication per day or the change in pitch, with the aid of an external evaluation device.

In a wristwatch-type electronic timepiece comprising an electro-mechanical transducer, it has heretofore been the practice to measure deviations in its operating rate by listening to the ticking sound produced by a standard timepiece while observing with the naked eye the display of the timepiece to be checked. Even in digital-display-type electronic timepieces which make use of liquid crystals and photodiodes as means for displaying the time, the above-described observation with the naked eye has been relied upon heretofore in order to montor their performance. With this procedure it is difficult to carry out a number of such measurements with sufficient precision to satisfy the requirements of mass production.

In the above-described electronic wristwatch comprising an electro-mechanical transducer, it has heretofore been proposed to measure the pitch of the timepiece automatically by detecting the ticking sound or the leakage flux produced by that transducer. In this case, if the operating speed of the electro-mechanical transducer of the electronic timepiece (such as a pulse-responsive motor advancing one step every second); is low the ticking rate or the leakage flux is small and, as a result, it takes a long time to measure the pitch of the timepiece.

In recent years, a highly precise crystal timepiece has come into wide use requiring accurate calibration. In such timepieces, however, the frequency instability of the clock signal derived from the ticking sound or the leakage flux and a low signal-to-noise ratio make it impossible to perform these measurements in the usual way with the desired degree of precision.

Furthermore, the conventional electronic timepiece comprising an electro-mechanical transducer is provided in its casing with a magnetic shield plate in order to reduce the adverse effects of external magnetic field. Such magnetic shields prevent the leakage flux produced by the electro-mechanical transducer from being detected outside the casing of the timepiece for checking purposes.

Timepieces of the digital-display type, such as those using liquid crystals or photodiodes do not need any magnetic shield structure. Still a booster circuit in the electric power supply driving a liquid-crystal cell of such a timepiece, e.g. a Cockcroft Walton circuit comprising in combination a diode and a condenser, can only produce a very small amount of leakage flux which makes it difficult to measure the operation rate.

Moreover, in such a system the flyback voltage of booster coil is a rather unreliable measuring variable.

In a photodiode display timepiece, on the other hand it is easy to measure the operating rate by intermittently exciting the photodiode during the period of measurement and detecting the leakage flux produced by such exciting current. The use of this technique, however, has the disadvantage that the electric battery supplying the time piece is rapidly exhausted.

An object of the invention is to provide an electronic wristwatch which can obviate the above-mentioned disadvantages and which can meausure the gain and loss in timekeeping in a highly precise manner with the aid of a simple detecting device.

In accordance with our present invention, we provide a transparent shield electrode within a metallic casing of an electronic timepiece of the digital-display type, this shield electrode being electrically connected to the casing and extending over the major part of the display means — including electrode segments arrayed in digital patterns to be selectively excited in a recurrent cycle — while leaving free at least one window offset from these segments. A monitoring conductor in the casing, electrically disconnected therefrom, is aligned with this window and is linked with the electronic clockwork of the timepiece by circuitry serving for the periodic pulsing of this conductor; the pulses are picked up by a detecting electrode on a transparent casing cover, overlying the display means, and are transmited to an evaluation device for measuring the recurrence rate of the pulses and thus the operating speed of the timepiece.

In a timepiece whose display means comprises a liquid-crystal cell with transparent walls whose inner surfaces carry transparent electrode segments energizable to form digital patterns and a common transparent electrode confronting all the segments, the monitoring conductor may form a coplanar extension of one of the electrode segments, especially a segment which is intermittently excited by the electronic clockwork in the course of a cycle. If such excitation involves a switch-over from cophasal to antiphasal pulsing of the segment and the common electrode, the respective pulses may be picked up by two detecting electrodes via a pair of windows in the shield electrode aligned with the coplanar segment extension and with a portion of the common electrode remote from the several electrode segments.

The invention will now be described in greater detail with reference to the accompanying drawin, wherein:

FIG. 1 is a vertical longitudinal section of a first embodiment of a liquid-crystal display timepiece according to the invention;

FIG. 2 is a plan view of an electrode array in a liquid-crystal display cell of the timepiece shown in FIG. 1;

FIG. 3 is a set of graphs showing the voltage waveforms of clock; signals and monitoring signals generated in the operation of the timepiece shown in FIGS. 1 and 2;

Figure 4:
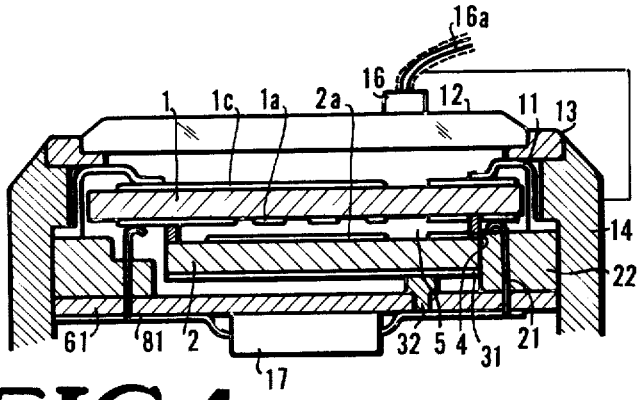
FIG. 4A is a vertical longitudinal section of a second embodiment of a liquid-crystal display timepiece according to the invention.
FIG. 4B is a plan view of an electrode array in a liquid crystal display of the timepiece shown in FIG. 4A.
FIG. 4C is a set of graphs showing voltage waveforms of a clock signal and a monitoring signal generated in the operation of the timepiece shown in FIGS. 4A and 4B.
Figure 4:
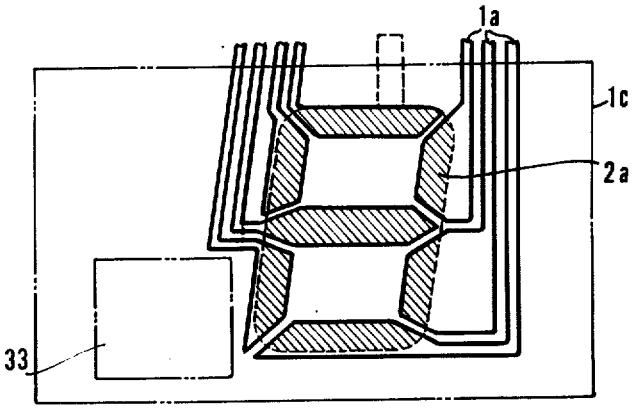
Figure 4:
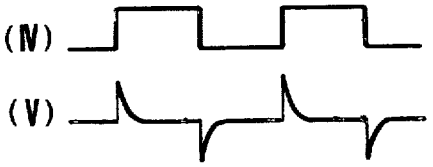

In FIG. 1 we have shown a first embodiment of a liquid-crystal display timepiece according to the invention. The timepiece comprises an upper glass wall 1 and a lower glass wall 2 of a liquid-crystal cell, and a reflecting plate 3 made of metal and cemented to the lower surface of the lower glass 2. Sandwiched between the upper and lower glasses 1 and 2 is a liquid-crystal 5 which is sealed in place by means of a spacer 4.

Reference numerals 1*a*, 1*b* designate a transparent pattern electrode and a transparent monitoring electrode deposited on the bottom surface of the upper glass 1 from the vapor phase; a layer 2*a* forms a transparent common electrode arranged on the top surface of the lower glass 2 to coact with electrodes 1*a*, 1*b* in producing a a display pattern upon selective excitation of certain electrode segments. A transparent shield electrode 1*c* arranged on the upper glass 1 of the liquid-crystal cell extends all over the top surface thereof except one area confronting the monitoring electrode 1*b* and another area confronting a monitoring position 2*a'* of the transparent common electrode 2*a* as shown in FIG. 2. A metallic base plate constituting a substrate of the timepiece is secured to a part of the reflecting plate 3 and supports an electronic clockwork 7 adapted to display the time with the aid of the liquid crystal, a flexible foil 8 on base plate 6 being soldered to both the electronic circuit 7 and the corresponding electrodes of the liquid-crystal cell for transmitting clock pulses from the electronic circuit 7 to these electrodes. An elastic rubber gasket 9 urges an electrically conductive part of the foil 8 against the corresponding cell electrodes and is held in position by a frame 10 of synthetic resin a metallic member 11, a supporting the liquid-crystal cell, is electrically connected to the transparent shield electrode 1*c* and to the metal part of the casing 14 of the timepiece. A protective glass cover 12 is supported by a ring 13 on the on the casing 14 which also contains an electric battery 15. A pair of detecting electrodes 16, 17 are disposed on the glass cover 12 for the purpose of measuring the gain and loss in timekeeping with the aid of electric fields established on the one hand between the detecting electrode 16 and the monitoring electrode portion 2*a'* and on the other hand between the detecting electrode 17 and the transparent monitoring electrode 1*b*. Shielded wires 16*a*, 17*a* respectively transmit the signals detected by electrodes 16, 17 to a measuring device (not shown), the shields of the these wires 16*a*, 17*a* being electrically connected to the casing 14 of the timepiece.

In FIG. 2 we show an array of the above-described cell electrodes. The transparent pattern electrode 1*a* is one of several such electrodes in different digital positions, arranged on the bottom surface of the upper glass 1 as is well known per se; the illustrated electrode has segments *a*, *e* – *g* shown in full line. Each pattern electrode serves to display units of time, i.e. seconds in the first digital position. The segments of electrode 1*a* are complemented by a further segment *b* integral with electrode 1*b* which forms a coplanar extesnion thereof.

The transparent common electrode 2*a* with its exposed monitoring portion 2*a'*, arranged on the top surface of the lower glass 27 is shown by dotted lines. In FIG. 2 shaded portions represent a digital display pattern.

The transparent shield electrode 1*c* arranged on the top surface of the upper glass 1 is shown by chain-dotted lines, those portions of electrode 1*c* which overlie the monitoring portion 2*a'* of the transparent common electrode 2*a* and the transparent pattern electrode 1*b* integral with segment *b* being broken away so as to form windows 1*c'*, 1*c''*, respectively offset from all the segments *a* – *g*.

A voltage wave of a clock signal applied to the transparent common electrode 2*g* is shown in graph I of FIG. 3, while a voltage wave of a clock signal applied to the segment extension 1*b* so as to display the segment *b* is shown in graph II thereof. These clock signals are in phase when the segment *b* is not to be displayed, as shown at the left side of FIG. 3, and are in phase opposition when the segment *b* is to be displayed as shown at the right side of FIG. 3.

Waveforms of differentiated voltages capacitively picked up by the detecting electrodes 16, 17, having steep leading edges, are shown in graphs I' and II' of FIG. 3, respectively. The waveform of the resultant differentiated voltage, obtained by summing the voltage waves I' and II', is shown in graph of FIG. 3.

The embodiment shown in FIGS. 1 and 2 operates as follows.

The clock signal delivered from the electronic circuit 7 is transmitted through the conductive foil 8 to the transparent common electrode 2*a* and transparent pattern electrode 1*b* of the liquid-crystal cell.

To the transparent common electrode 2*a* is applied the voltage shown at I in FIG. 3, while to the transparent pattern electrode 1*b* is applied to the voltage shown at II in FIG. 3. With the two voltages in phase opposition as shown at the right side of FIG. 3, the segment *b* to be displayed is exerted by the resulting voltage difference.

If the detecting electrodes 16 and 17 are disposed on those portions of the glass cover 12 which overlie the windows 1*c'*, 1*c''* registering with monitoring conductors 2*a'* and 1*b*, respectively, electric fields are set up between these conductors and the confronting detecting electrodes. Thus, the voltages shown at I' and II' in FIG. 3 are detected by the electrodes 16, 17 and delivered to the shielded wires 16*a*, 17*a*, respectively. If the segment *b* is not displayed, the detected signal is a series of steeply rising pulses representing the sum of the two voltages I' and II' as shown in graph III at the left side of FIG. 3. On the other hand, if the segment *b* is displayed, a near-zero signal representing the difference of these voltages I' and II' as shown in graph III at the right side of FIG. 3 is detected.

Figure 5:
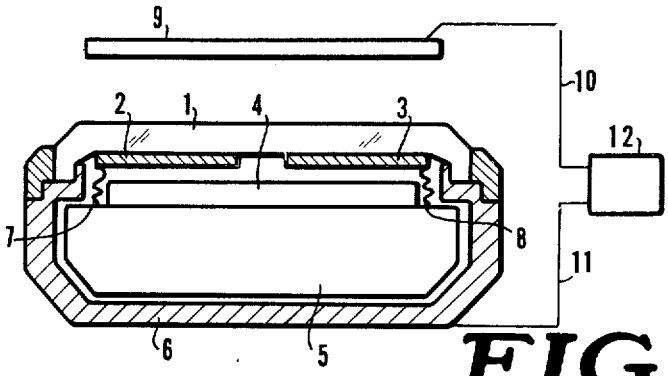
FIG. 5 is a vertical longitudinal section of a third embodiment of a liquid-crystal display timepiece according to the invention.

The described combinations of signals are delivered from the shielded wires 16*a*, 17*a* to an evaluating circuit, such as a device 59*c* shown in FIG. 5, which discriminated between these two combinations to distinguish the condition in which the segment *b* is displayed from the condition in which it is not displayed.

By this means it is possible to determine whether or not the segment *b* is displayed and to measure the gain and loss in timekeeping with respect to a standard timepiece by a highly precise manner.

The casing 14 is grounded and the metallic reflecting plate 3 is electrically connected to it through the base plate 6. The transparent shield electrode 1*c* on the top surface of the upper glass 1 of the liquid-crystal cell is electrically connected through the supporting member 11 to the casing 14, as are the shields of leads 16*a*, 17*a* of electrodes 16, 17. Thus, the electric signals emitted by the electronic circuit 17 are shielded by means of the reflecting plate 3 and, except for those delivered to the segment *b*, by means of the transparent electrode 1*c*. All these electric signals are shunted to ground through the casing 14 without significantly affecting the detecting electrodes 16, 17. As a result, electrodes 16 and 17 can precisely detect the electric signals applied to the transparent common electrode 2*a* and the transparent pattern electrode 1*b* without a risk of being affected by the other signals.

In addition, the use of the shielding described enables utilization of small detecting electrodes which can easily pick up the electric signals applied to the transparent common and pattern electrodes.

As will be readily apparent, segments *a* – *g* can be energized in the proper combinations to display the digits from 0 through 9. Each of these combinations, except that for digits "5" and "6", includes the segment *b* which is therefore de-energized once per 10-second cycle for two consecutive seconds. Segment *c* is used for every digit except "2" and is therefore also de-energized (for one second) once every 10 seconds. Segment *g* does not intervene in the display of digits "0", "1" and "7" so that a monitoring signal is shown in the let-hand half of graph III (FIG. 3) occurs twice per cycle. In the 10-second position of the time display, such a signal is generated by segment *b* or *c* once every 60 seconds. There is thus available a choice of display positions as well as electrode segments for measuring the operating rate of the timepiece.

In FIG. 4A, which shows a second embodiment of a liquid-crystal display timepiece according to the invention, reference numeral 61 designates a ase plate provided on its bottom surface with an electronic circuit or clockwork 7 and printed wires 81 for transmitting the clock signal from this circuit 17 to the electrodes 1*a*, 1*b* of the liquid-crystal cell via terminals 21 soldered thereto. A member 22 holds the terminals 21 in position. Another terminal 32 is electrically connected to a reflecting plate 31 for delivering a clock signal thereto for measuring the operation ratio of the timepiece, e.g. at a frequency of one clock pulse every 30 seconds.

Parts already described are denoted in FIG. 4A by the same reference numerals as in the embodiment shown in FIG. 1.

In the present embodiment, the transparent pattern electrodes 1*a*, 1*b*, transparent common electrode 2*a* and transparent shield electrode 1*c* are arranged as shown in FIG. 4B. The transparent shield electrode 1*c* is provided, at a location offset from the transparent pattern electrodes 1*a*, 1*b* and the transparent common electrode 2*a* with a window 33 through which is detected the clock signal applied to the reflecting plate 31 acting as a monitoring conductor.

The embodiment shown in FIGS. 4A and 4B operates as follows. A clock-signal voltage having a frequency of 1/30 Hz as shown in graph IV of FIG. 4C is applied from the electronic circuit 7 through a printed wire 81 and terminal 32 to the reflecting plate 31. If the detecting electrode 16 is disposed on that part of the glass cover 12 which overlies the window 33 of the transparent shield electrode 1*e*, an electric field exists between the reflecting plate 31 and the detecting electrode 16 whereby a monitoring signal as shown in graph V of FIG. 4C can be obtained from the shielded wire 16*a*. This monitoring signal is compared with a standard signal so as to measure the gain or loss in timekeeping. From the result thus measured the time deviation per day is calculated.

Other clock signals not used for monitoring purposes are shielded from electrode 16 by the transparent electrode 1*c* and passed to ground through the metal casing 14; the shielding envelope of wire 16*a* is likewise grounded. The present embodiment also permits the clock signal applied to the reflecting plate 31 to be suitably selected.

Instead of being carried on the transparent cell wall 1, the grounded shield electrode 1*c* may be disposed on the glass cover 12. To the monitoring conductors such as electrodes 1*b*, 2*a*', 31 may be applied not only the voltage which energizes the segmented and common electrodes 1*a*, 2*a* but also a special signal.

Figure 6:
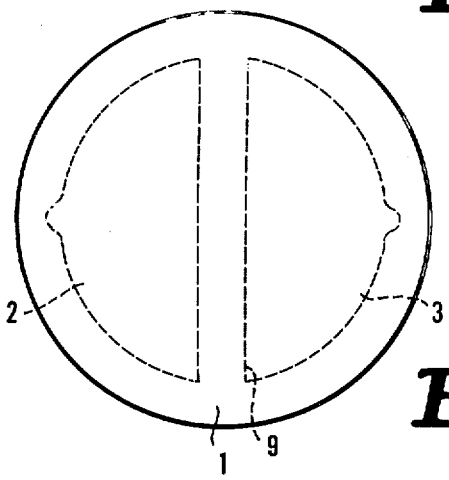
FIG. 6 is a plan view of electrodes arranged on a glass cover enabling observation of the digital patterns in the timepiece shown in FIG. 5.

In FIGS. 5 and 6, where we have shown a third embodiment of a liquid-crystal display timepiece according to the invention, reference numeral 51 designates a protective glass cover for the casing 56 of the timepiece on whose inner surfact two transparent electrode films 52, 53 are deposited from the vapor phase. Films 52 and 53 are respectively connected to a high-frequency and a low-frequency pulse source (not shown) within the casing, each generating a standard clock signal frequency for digital indication such, for example, as 128 Hz in the case of film 52 and in the case of film 53. A display plate 54 of a photodiode is carried by an electronic circuit 55 from which lead wires 57, 58 made of, for example, electrically conductive rubber extend to the electrode films 52, 53. An electrode plate 59 for detecting the clock signal from the liquid-crystal display timepiece, constructed as above described, is provided with a terminal 59*a* connected, together with a grounded terminal 59*b* of the metal casing 56, to an external evaluating device 59*c* for measuring the operation ratio of the timepiece.

Figure 7:
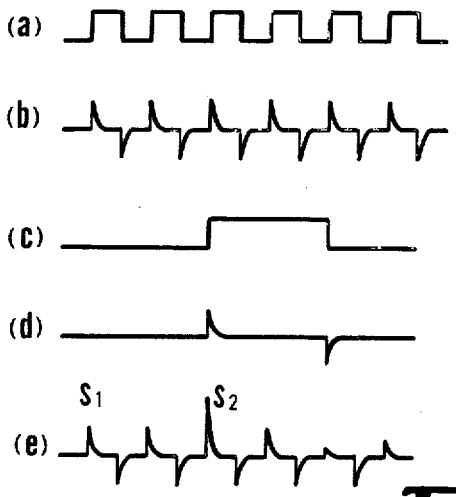
FIG. 7 is a set of graphs showing voltage waveforms of clock signals and monitoring signals generated in the operation of the timepiece shown in FIGS. 5 and 6.

In FIG. 7 graph, VI shows a voltage wave appearing at the electrode film 52 graph, VII shows a differentiated voltage wave picked up by the detecting electrode plate 59 with the aid of the pulse train of graph VI, graph VIII shoes a voltage pulse appearing at the electrode film 53, grapn IX shows a differentiated voltage wave picked up by the detecting electrode plate 59 with the aid of the voltage pulse of graph VIII, and graph X shows a differntiated voltage wave picked up by the detecting electrode plate 59 and supplied to the evaluation device 59*c*.

The embodiment of FIGS. 5-7 operates as follows. If the clock-signal voltage shown in graph VI of a FIG. 7 is applied to the electrode film 52 shown in FIGS. 5 and 6 and the clock-signal voltage shown in graph VIII is applied to the electrode film 53 with their leading and trailing edges coinciding, as shown electrode plate 59 disposed on the glass cover 51 and shielded from casing 56, detects a series of voltage pulses as shown in X graph FIG. 7 of synthesized from the pulse train of graphs VII and IX. If it is desired to measure the instantaneous pitch by means of the evaluating device 59*c*, a signal $S_1$ corresponding to the spikes of graph VII can be detected and measured. If it is desired to measure the time difference per day, a signal $S_2$ coinciding with the positive spike of graph IX can be detected and measured, the signal pulse of graph VIII in FIG. 7 recurring once every minute. In this case, it is not necessary to operate the photodiode 54 so that one extra current is required for the measurement of the time difference per day. Even if the time is normally displayed by the liquid-crystal, the electrode film 52 may be omitted provided the consumed current can be disregarded. The electrode film 53, provided for measuring the diurnal time difference can then be used exclusively so as to deliver the signal for the display surface.

In display-type electronic wristwatch comprising an electro-mechanical transducer, either one or both of the electrode films 52 and 53 may be disposed adjacent the display surface as, for example, on the inner surface of the glass cover 51, whereby the operating rate of the timepiece can be measured in a highly precise and simple manner.

What is claimed is:

1. In an electronic timepiece provided with a metallic casing, display means including electrode segments arrayed in digital patterns to be displayed in a recurrent cycle, and an electronic clockwork for selectively exciting said segments to establish said patterns, the combination therewith of a transparent cover on said casing overlying said display means and enabling said patterns to be observed, a transparent shield electrode within said casing electrically connected thereto and extending over the major part of said display means while leaving free at least one window offset from said segments, at least one monitoring conductor in said casing electronically disconnected therefrom and aligned with said window, circuit means linking said monitoring conductor with said electronic clockwork for periodic pulsing thereby, at least one detecting electrode on said cover aligned with said window for picking up pulses from said monitoring conductor, and evaluation means connected to said detecting electrode for measuring the recurrence rate of said pulses.

2. The combination defined in claim 1 wherein said detecting electrode is provided with a lead for delivering said pulses to said evaluation means, said lead having a shielding envelope electrically connected to said casing.

3. The combination defined in claim 1 wherein said display means comprises a liquid-crystal cell having a pair of transparent walls with closely spaced inner surfaces, first transparent electrode means on one of said inner surfaces forming said segments, and second transparent electrode means on the other of said inner surfaces common to and confronting all said segments, said shield electrode being disposed between said cell and said cover.

4. The combination defined in claim 3 wherein said monitoring conductor comprises part of one of said transparent electrode means.

5. The combination defined in claim 4 wherein said monitoring conductor forms an extension of one of said segments on said one of said inner surfaces, said one of said segments being intermittently excitable by said electronic clockwork in the course of said recurrent cycle.

6. The combination defined in claim 5 wherein said shield electrode leaves free another window overlying a portion of said second transparent electrode means remote from said segments, further comprising another detecting electrode on said cover aligned with said other window and connected to said evaluation means, said one of said segments being pulsed cophasally with said second transparent electrode means during one part of said recurrent cycle and antiphasally therewith during another part of the cycle.

7. The combination defined in claim 6 wherein each of said detecting electrodes is connected to said evaluation means via a respective lead having a shielding envelope electrically connected to said casing.

8. The combination defined in claim 3, further comprising a reflecting plate in said casing disposed on an outer surface of one of said transparent walls remote from said cover, said monitoring conductor being part of said reflecting plate.

* * * * *